US006315642B1

(12) United States Patent
Videcoq et al.

(10) Patent No.: US 6,315,642 B1
(45) Date of Patent: Nov. 13, 2001

(54) METHOD AND APPARATUS FOR THE TRACING OF SPECTACLE FRAMES, AND CORRESPONDING GRINDING MACHINE

(75) Inventors: Jean-Jacques Videcoq, Pavilly; Stephane Pascal Bertrand Bonbony, Le Grand Quevilly, both of (FR)

(73) Assignee: Briot International, Pont de L'Arche (FR)

( * ) Notice: Subject to any disclaimer, the term of this patent is extended or adjusted under 35 U.S.C. 154(b) by 0 days.

(21) Appl. No.: 09/549,040

(22) Filed: Apr. 13, 2000

(51) Int. Cl.[7] ..... B24B 1/00
(52) U.S. Cl. ..... 451/42; 451/384
(58) Field of Search ..... 451/41, 42, 43, 451/44, 384, 390, 921, 281, 5, 239, 240; 33/174 P, 200, 174 A

(56) References Cited

U.S. PATENT DOCUMENTS 3,828,842 * 8/1974 Tagnon ..... 164/334
3,899,851 * 8/1975 Asselin et al. ..... 51/101 LG
4,051,601 * 10/1977 Godot ..... 33/174 P
5,775,973 * 7/1998 Watanabe ..... 451/5
6,122,063 * 9/2000 Berndt et al. ..... 356/376

* cited by examiner

*Primary Examiner*—Derris H. Banks
(74) *Attorney, Agent, or Firm*—Wenderoth, Lind & Ponack, L.L.P.

(57) ABSTRACT

This tracing apparatus (11) comprises two tracers (18, 27), which comprise a fine tracer (18), which is brought to bear against the bottom of the bezel of a frame ring (1) and which executes a revolution around the said frame ring in order to determine its form in space, and a second tracer (27), the profile of which matches that of the groove of the bevelling wheel. The difference in penetration of the pointed tips of the two tracers at the same point on the periphery of the bezel is measured in this way, and the corresponding information is sent to the grinding machine in order to control the glass-carrying carriage.

14 Claims, 3 Drawing Sheets

METHOD AND APPARATUS FOR THE TRACING OF SPECTACLE FRAMES, AND CORRESPONDING GRINDING MACHINE

The present invention relates to a method for the tracing of a bezel of a spectacle frame ring for the purpose of supplying data representing the contour of the bezel to a spectacle glass grinding machine which comprises a bevelling wheel having a bevelling groove of standard profile, the said method being of the type in which the frame ring is positioned, a fine tracer is introduced into the bezel in a predetermined radial orientation relative to a predetermined axis of rotation, until the tracer is in contact with the bottom of the bezel, and the tracer is caused to execute a revolution about this axis, at the same time ensuring the contact of the tracer with the bottom of the bezel at least for a predetermined series of radial orientations.

The invention also relates to a tracing apparatus intended for carrying out such a method and to a spectacle glass grinding machine equipped with such an apparatus.

The context and the basic problem of the invention will first be explained with reference to FIGS. 1 to 3 of the accompanying-drawings.

FIG. 1 illustrates the section of a metal or plastic ring 1 of a spectacle frame, and FIG. 2 illustrates a front view of the same ring 1.

As seen in FIG. 1, the ring 1 comprises, on its inner periphery, a groove or bezel 2 in the form of a V open at 120° and with a flat bottom 3.

FIG. 3 illustrates diagrammatically, in perspective, the parts, relevant to the invention, of a conventional spectacle glass grinding machine:

- A wheel train 4, the horizontal axis X—X of which is integral with the stand (not illustrated) of the machine. This wheel train comprises at least one roughing wheel 5 having a substantially cylindrical outer surface, and a bevelling wheel 6 provided with a standard groove 7 in the form of a V open at 120°. The drive motor of the wheel train is indicated at 8.
- A glass-carrying carriage indicated diagrammatically by its horizontal axis Y—Y parallel to the axis X—X. O indicates the centre of a glass to be ground 9, held on the carriage by a two-part mandrel (not illustrated) which extends along the axis Y—Y and which forms part of the carriage. In this example, the centre O is located on the axis Y—Y.
- Electronic carriage control means 10. During the bevelling operation, these means control the displacement of the pointed tip 0 along the axis Y—Y and perpendicularly to the latter, as indicated by arrows, as a function of the angular position of the glass which is driven in relatively slow rotation about the axis Y—Y by a suitable motor (not illustrated).
- A tracing apparatus 11 which may be integrated into the machine or carried by a separate stand. Such an apparatus is conventional and is sold under the trademark SCANFORM by the company BRIOT International.

The apparatus 11 comprises: a horizontal circular plate 12 rotatable about its vertical axis Z—Z; a substructure 13 fastened to this plate and provided with parallel and horizontal rods 14 located on either side of a diameter of the plate 12; a slide 15 mounted moveably on the rods 14; a vertical sleeve 16 fastened to the slide 15; a tracer-carrying rod 17 mounted slideably in the sleeve 16; and a tracer 18 fastened to the upper end of the rod 17.

The tracer 18 is a so-called "fine" tracer, that is to say, at least in its active part, it is in the form of a pointed tip, the vertical thickness of which is smaller than that of the bottom 3 of the bezel 2, as may be seen from the broken lines in FIG. 1.

The apparatus 11 also comprises displacement means, the function of which will become apparent below, a sensor 19 of the angle of rotation of the plate 12, a sensor 20 of the position of the slide 15 along the corresponding diameter of the plate and a sensor 21 of the vertical position of the tracer 18. These sensors send corresponding signals to an electronic unit 22 which operates the control means 10. Suitable interfaces are, of course, provided between the electronic elements of the assembly as a whole.

The conventional procedure takes place as follows.

The frame ring 1 is positioned above the apparatus 11 by means of suitable grippers indicated diagrammatically at 23 in FIGS. 10 to 12. Such grippers are described, for example, in the Applicant's FR-A-2 754 356.

The plate 12 is then brought into a predetermined initial angular position indicated at 24 in FIG. 2. The rod 17 is brought along the axis Z—Z by the displacement of the slide 15, and the tracer is brought substantially level with the bezel. The slide 15 is then pushed away from the axis Z—Z with a predetermined constant force, typically of 60 gf, until the pointed tip of the tracer 18 is in contact with the bottom of the bezel at the pointed tip 25 (FIG. 2), as illustrated in FIG. 1.

The means for the vertical displacement of the rod 17 comprises a friction disc which co-operates with this rod when the latter coincides with the axis Z—Z. As soon as the rod 17 leaves this position, it can be displaced vertically by sliding under the effect of a vertical force, whilst remaining immobile in the absence of such a force by virtue of a counterweight (not illustrated) with which it is equipped.

For this angular position $\theta=0$ of the plate, the sensors 20 and 21 measure the radial displacement $\rho_0$ of the slide 15 and the level $z_0$ of the plate.

The plate 12 is then rotated over one complete revolution, the tracer being permanently applied with the abovementioned constant force in the bezel 2. The sensors 19 to 21 thus supply the unit 22 with a set of triplets ($\theta$, $\rho$, z) which represent the spatial form of the bezel.

On the basis of this information transmitted to the control means 10, the glass 9 intended for equipping the frame ring 1 will be roughed by the wheel 5 and then bevelled by the wheel 6. The control of the glass-carrying carriage will be such that the edge 26 of the bevel is at each moment located at the distance $\rho$ from the axis Y—Y which corresponds to the angular position $\theta$ of the glass in relation to its original position.

If the bezel 2 has, in fact, an opening of 120° or a greater opening, the glass will fit perfectly into the ring 1 (FIG. 4). If, by contrast, this opening is smaller than 120°, the glass will interfere with the frame (FIG. 5) and cannot be fitted. It will then be necessary to recover the glass and carry out a reworking operation.

In order to avoid this additional manipulation, it has been proposed (FR-A-2,637,830) to use a thick tracer having a profile in the form of a V at 120° of the bevelling groove 7. The glass then undoubtedly fits into the bezel, but at the expense of the two following disadvantages:

- on the one hand, the thick tracer tends to escape from the bezel during tracing, unless increased force is exerted on it, which then risks deforming the frame ring;
- on the other hand, the rapid wear of the tracer alters its profile, so that the angle of 120° is no longer guaranteed, thus impairing the tracing accuracy.

The object of the invention is to make it possible to carry out tracing reliably and economically, avoiding the need to recover the glass after bevelling, whatever the opening of the V of the bezel or even the form of its section.

To achieve this, the subject of the invention is a tracing method of the type mentioned at the beginning, characterized in that, furthermore, a second tracer, the profile of which substantially matches that of the said groove, is introduced at a predetermined point on the periphery of the bezel, and information representing the difference in penetration of the pointed tips of the two tracers into the bezel at the said predetermined point is supplied to the grinding machine.

This method may comprise both or either one of the following characteristics:

- the relative position of the pointed tips of the two tracers is measured beforehand by bringing them successively into contact with the same reference surface parallel to the said axis, and information representing this relative position is supplied to the grinding machine;
- the two tracers are integral with the same supporting rod parallel to the said axis and moveable longitudinally, and the two tracers are successively brought level with the bezel at the said common point of penetration.

Another subject of the invention is, correlatively, an apparatus for the tracing of spectacle frames, of the type comprising: means for positioning a frame ring; a fine tracer carried by a tracer support; means for displacing the tracer support about an axis of rotation along this axis and radially relative to this axis; and means for measuring, for each angular position of the tracer support, the displacement of this support radially and, if appropriate, along the axis of rotation, until the tracer is in contact with the bottom of the bezel of the frame ring, characterized in that it comprises, furthermore, a second tracer having a profile substantially matching that of a standard spectacle glass bevelling groove, and means for introducing this second tracer at a predetermined point on the periphery of the bezel.

This apparatus may comprise one or more of the following characteristics, taken separately, in all their technically possible combinations:

- the two tracers are carried by the same tracer support and are offset relative to one another along the said axis of rotation;
- the support is a rod mounted slideably along the said axis of rotation in relation to a carriage, this carriage being mounted so as to be radially moveable on a plate rotatable about the said axis;
- the apparatus comprises means for supplying the grinding machine with information representing the difference in penetration of the pointed tips of the two tracers into the bezel at the said predetermined point;
- the apparatus comprises calibration means designed to bring the two tracers successively into contact with the same reference surface at the said axis, and means for deducing therefrom the relative position of the pointed tips of the two tracers.

Yet another subject of the invention is a spectacle glass grinding machine, of the type comprising a wheel train which comprises a bevelling wheel having a standard bevelling groove, a carriage carrying a glass to be ground, carriage control means designed to bring the glass to be ground at least onto the bevelling wheel, and a spectacle frame tracing apparatus as defined above designed to supply the said control means with data representing the contour of the bezel of a frame ring The tracing apparatus may, in particular, be integrated into the machine.

An exemplary embodiment of the invention will now be described with reference to the accompanying drawings, in which.

As illustrated in FIGS. 6 to 12, the apparatus 11 is modified by the addition to the rod 17, at a particular distance below the tracer 18, of a (vertically) thick additional tracer 27, the vertical profile of which is in the form of a V open at 120°, that is to say matching that of the standard bevelling groove Tracing is then carried out in the following way.

Figure 7:
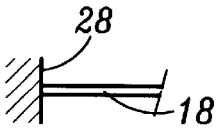
FIGS. 7 and 8 illustrate the calibration of the assembly with two tracers.
Figure 8:
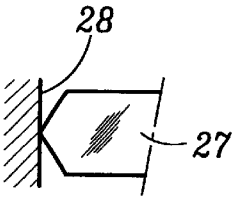

The apparatus 11 is calibrated by positioning the plate 12 in a predetermined angular position and then by bringing the tracers 18 and 27 successively into contact with the same reference surface 28 parallel to the axis Z—Z (FIGS. 7 and 8). The sensor 20 then sends to the unit 22 a signal representing the difference $\Delta\rho 1$ between the pointed tips of the two tracers. This operation is subsequently carried out at time intervals selected by the operator, for example after a predetermined number N of tracing cycles.

Figure 9:
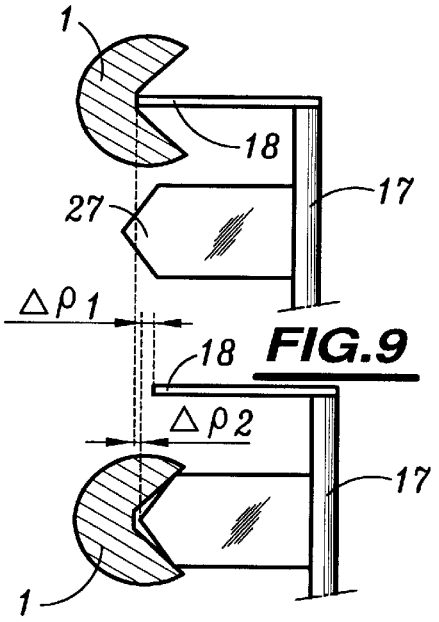
FIG. 9 illustrates tracing carried out by means of this assembly.
Figure 10:
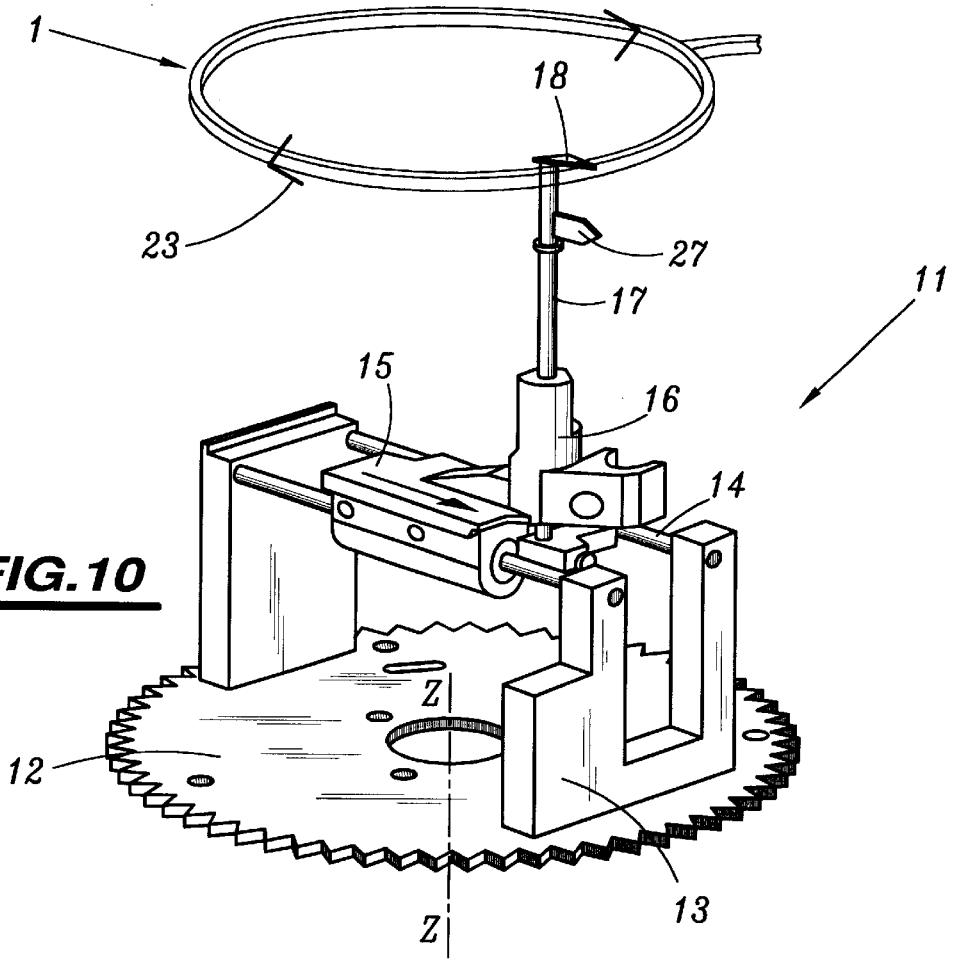
FIG. 10 is a partial perspective view, similar to that of FIG. 3, illustrating the initial phase of tracing by means of the fine tracer.
Figure 11:
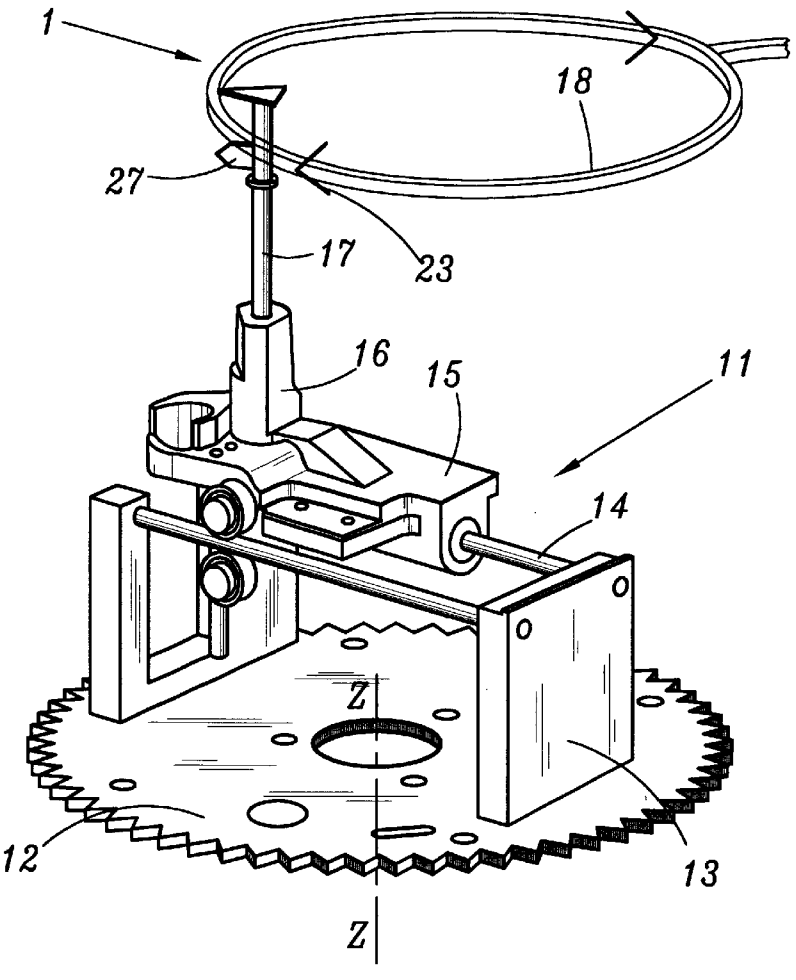
FIG. 11 is a similar view illustrating a subsequent phase of tracing by means of the fine tracer.

Then, with a frame ring 1 being positioned in the grippers 23, as before, a first tracing by means of the tracer 18 is carried out, as described above, with this tracer in contact with the bottom 3 of the bezel (FIGS. 9 to 11). FIG. 10 illustrates the initial position of the tracer 18 during this tracing operation, and FIG. 11 illustrates a subsequent position at approximately 180° from the preceding position.

Figure 12:
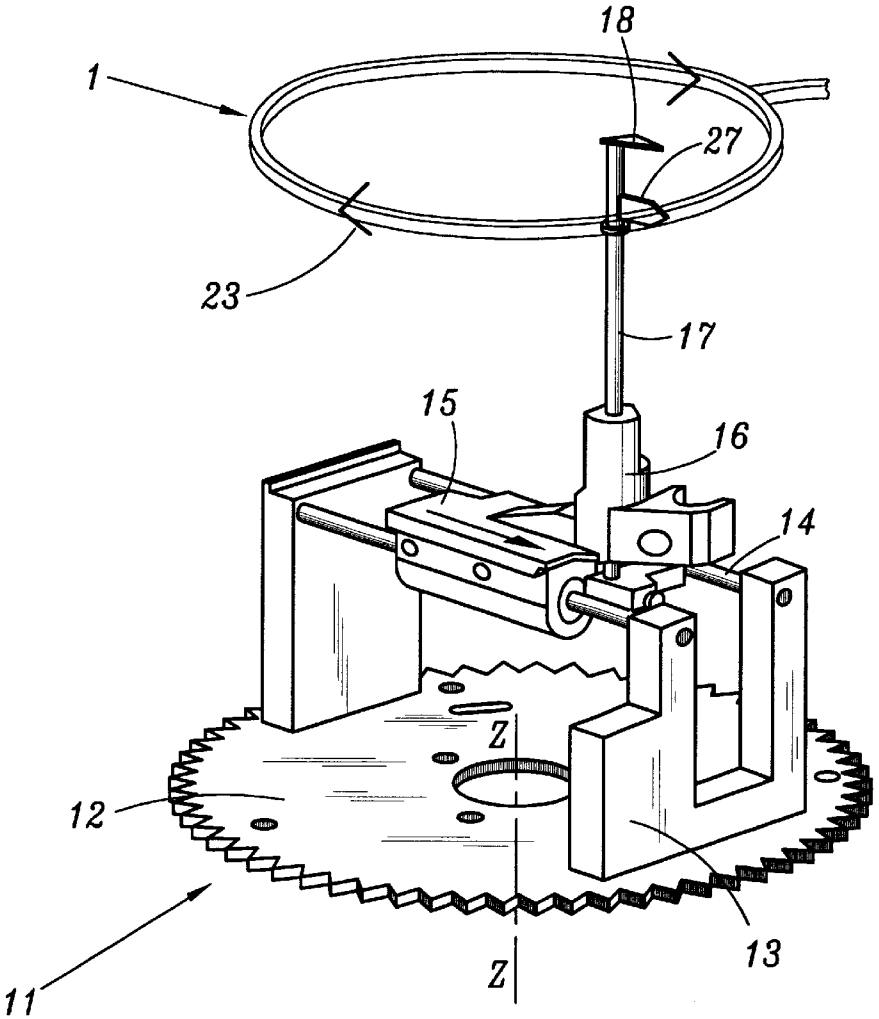
FIG. 12 is a similar view illustrating tracing by means of the thick tracer.

Subsequently, with the plate 12 and the slide 15 returned to their initial positions, the rod 17 is raised so as to bring the tracer 27 substantially into the plane of the bezel. The slide is then displaced in order to bring the tracer 27 into contact with the bezel (FIGS. 9 and 12).

Figure 1:
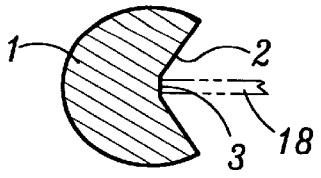
FIG. 1 illustrates the section of a spectacle frame ring.
Figure 2:
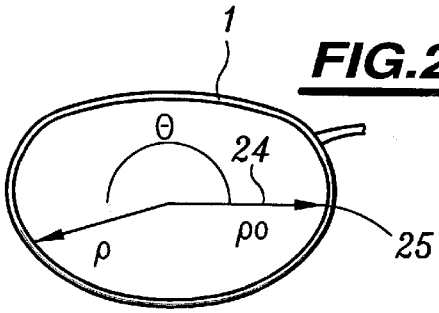
FIG. 2 illustrates a front view of the same frame ring.
Figure 4:
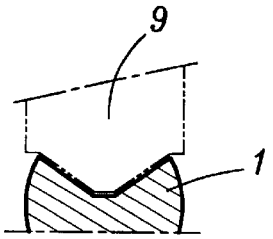
FIG. 4 illustrates the fitting of the bevelled glass into a bezel open at 120°.
Figure 5:
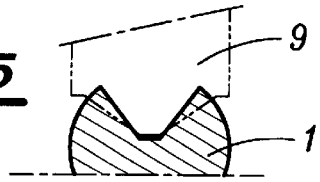
FIG. 5 illustrates the interference of the bevelled glass with a bezel open at less than 120°.
Figure 3:
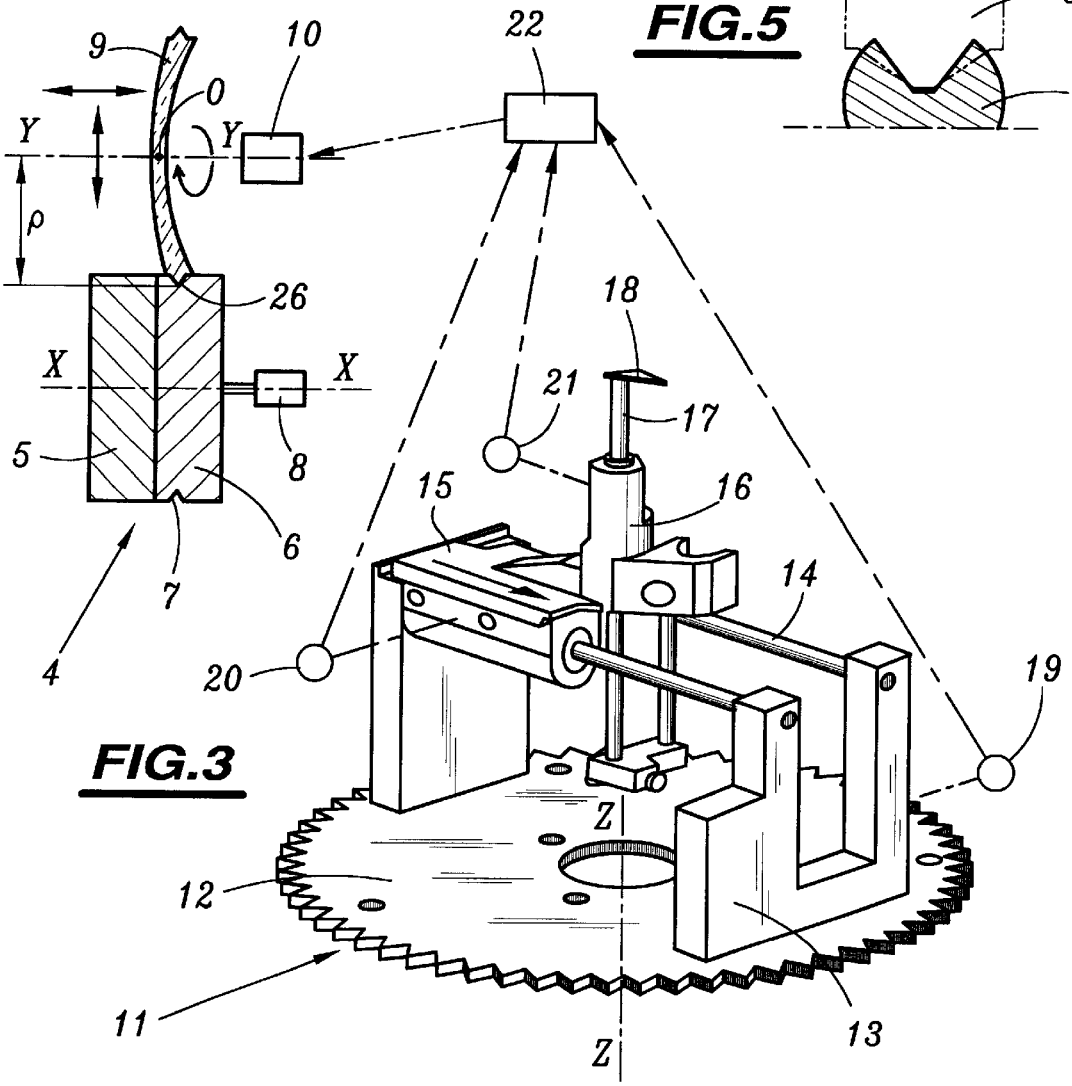
FIG. 3 illustrates diagrammatically, in perspective, the parts, relevant to the invention, of a conventional spectacle glass grinding machine.
Figure 6:
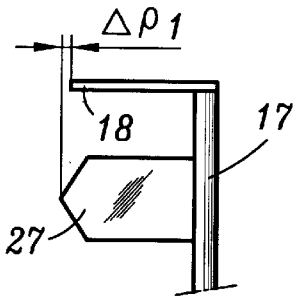
FIG. 6 illustrates an assembly with two tracers according to the invention.

If the bezel is open at 120° or more, the pointed tip of the tracer 27 will touch the bottom of the bezel, and the difference in displacement of the carriage will be equal to the abovementioned quantity $\Delta\rho 1$ of FIG. 6.

By contrast, if the opening of the bezel is smaller than 120°, as illustrated in FIG. 9, the tracer 27 will not penetrate completely into the bezel, and its position will correspond to that of the glass bevelled by the groove 7.

The difference in radial displacement of the two tracers, which is designated as $\Delta\rho 2$, is supplied to the unit 22 by the sensor 20, and the glass-carrying carriage will be controlled by the means 10 as a function of the results of the first tracing, on the one hand, and of the quantities $\Delta\rho 1$ and $\Delta\rho 2$, on the other hand.

In this way, the bevelled glass will always fit into the bezel, whatever the opening angle of the latter or even the form of its section, without any recovery of the glass being necessary.

It should be noted that only the first fine tracer 18, which remains in the bezel without difficulty during the rotation of the plate 12, rubs against the frame ring and experiences wear, this being taken into account by the calibration described above with regard to FIGS. 7 and 8. On the contrary, the thick tracer 27 only comes into contact with the frame ring 1 at one point, without any relative movement between this tracer and the ring 1. The thick tracer therefore has no tendency to escape from the bezel and does not undergo any wear.

Alternatively, the tracer 27 may be rotated over a small angle, for example of 1 to 2°, in order to obtain a set of measurements, the average of which is taken. This makes it possible to avoid any risk of obtaining a deviant measurement at a particular point.

What is claimed is:

1. Method for the tracing of a bezel (2) of a spectacle frame ring (1) for the purpose of supplying data representing the contour of the bezel to a spectacle glass grinding machine which comprises a bevelling wheel (6) having a bevelling groove (7) of standard profile, of the type in which the frame ring (1) is positioned, a fine tracer (18) is introduced into the bezel (2) in a predetermined radial orientation (24) relative to a predetermined axis of rotation (Z—Z), until the tracer is in contact with the bottom (3) of the bezel, and the tracer is caused to execute a revolution about this axis, at the same time ensuring the contact of the tracer with the bottom of the bezel at least for a predetermined series of radial orientations, characterized in that, furthermore, a second tracer (27), the profile of which substantially matches that of the said groove, is introduced at a predetermined point on the periphery of the bezel (2), and information representing the difference (Δρ2) in penetration of the pointed tips of the two tracers into the bezel at the said predetermined point is supplied to the grinding machine.

2. Method according to claim 1, characterized in that the relative position (Δρ1) of the pointed tips of the two tracers (18, 27) is measured beforehand by bringing them successively into contact with the same reference surface (28) parallel to the said axis (Z—Z), and information representing this relative position is supplied to the grinding machine.

3. Method according to claim 1, characterized in that the two tracers (18, 27) are integral with the same supporting rod (17) parallel to the said axis (Z—Z) and moveable longitudinally, and in that the two tracers are successively brought level with the bezel (2) at the said common point of penetration.

4. Apparatus for the tracing of spectacle frames, of the type comprising: means (23) for positioning a frame ring (1); a fine tracer (18) carried by a tracer support (17); means for displacing the tracer support about an axis of rotation (Z—Z) along this axis and radially relative to this axis; and means (19 to 21) for measuring, for each angular position of the tracer support (17), the displacement of this support radially and, if appropriate, along the axis of rotation, until the tracer (18) is in contact with the bottom (3) of the bezel (2) of the frame ring (1), characterized in that said apparatus comprises, furthermore, a second tracer (27) having a profile substantially matching that of a standard spectacle glass bevelling groove (7), and means for introducing this second tracer at a predetermined point on the periphery of the bezel.

5. Apparatus according to claim 4, characterized in that the two tracers (18, 27) are carried by the same tracer support (17) and are offset relative to one another along the said axis of rotation (Z—Z).

6. Apparatus according to claim 5, characterized in that the support (17) is a rod mounted slideably along the said axis of rotation (Z—Z) in relation to a carriage (15), this carriage being mounted so as to be radially moveable on a plate (12) rotatable about the said axis.

7. Apparatus according to claim 6, further comprising means (19 to 22) for supplying the grinding machine with information representing the difference (Δρ2) in penetration of the pointed tips of the two tracers (18, 27) into the bezel (2) at the said predetermined point.

8. Apparatus according to claim 7, further comprising calibration means designed to bring the two tracers (18, 27) successively into contact with the same reference surface (28) parallel to the said axis (Z—Z), and means (20) for deducing therefrom the relative position (Δρ1) of the pointed tips of the two tracers.

9. Spectacle glass grinding machine, of the type comprising a wheel train (4) which comprises a bevelling wheel (6) having a standard bevelling groove (7), a carriage carrying a glass to be ground, carriage control means (10) designed to bring the glass to be ground at least onto the bevelling wheel (6), and a spectacle frame tracing apparatus (11) designed to supply the said control means with data representing the contour of bezel (2) of a frame ring (1), characterized in that the tracing apparatus (11) is according to claim 8.

10. Spectacle glass grinding machine, of the type comprising a wheel train (4) which comprises a bevelling wheel (6) having a standard bevelling groove (7), a carriage carrying a glass to be ground, carriage control means (10) designed to bring the glass to be ground at least onto the bevelling wheel (6), and a spectacle frame tracing apparatus (11) designed to supply the said control means with data representing the contour of the bezel (2) of a frame ring (1), characterized in that the tracing apparatus (11) is according to claim 7.

11. Spectacle glass grinding machine, of the type comprising a wheel train (4) which comprises a bevelling wheel (6) having a standard bevelling groove (7), a carriage carrying a glass to be ground, carriage control means (10) designed to bring the glass to be ground at least onto the bevelling wheel (6), and a spectacle frame tracing apparatus (11) designed to supply the said control means with data representing the contour of the bezel (2) of a frame ring (1), characterized in that the tracing apparatus (11) is according to claim 6.

12. Spectacle glass grinding machine, of the type comprising a wheel train (4) which comprises a bevelling wheel (6) having a standard bevelling groove (7), a carriage carrying a glass to be ground, carriage control means (10) designed to bring the glass to be ground at least onto the bevelling wheel (6), and a spectacle frame tracing apparatus (11) designed to supply the said control means with data representing the contour of the bezel (2) of a frame ring (1), characterized in that the tracing apparatus (11) is according to claim 5.

13. Spectacle glass grinding machine, of the type comprising a wheel train (4) which comprises a bevelling wheel (6) having a standard bevelling groove (7), a carriage carrying a glass to be ground, carriage control means (10) designed to bring the glass to be ground at least onto the bevelling wheel (6), and a spectacle frame tracing apparatus (11) designed to supply the said control means with data representing the contour of the bezel (2) of a frame ring (1), characterized in that the tracing apparatus (11) is according to claim 4.

14. Machine according to claim 13, characterized in that the tracing apparatus (11) is integrated into the machine.

* * * * *